US005727345A

United States Patent [19]

Sullivan

[11] Patent Number: 5,727,345

[45] Date of Patent: Mar. 17, 1998

[54] SEMIAUTOMATIC FIREARM WITH GAS OPERATED ROTATING CYLINDER

[75] Inventor: Robert Sullivan, Snyder, Okla.

[73] Assignee: Hotshot, Inc., Northbrook, Ill.

[21] Appl. No.: 664,482

[22] Filed: Jun. 17, 1996

[51] Int. Cl.[6] ..... F41C 3/14; F41A 15/02; F41A 9/61

[52] U.S. Cl. ..... 42/59; 42/60; 42/65; 42/68

[58] Field of Search ..... 42/60, 68, 65, 42/67, 59

[56] References Cited

U.S. PATENT DOCUMENTS

| | | | |
|---|---|---|---|
| 364 | 8/1837 | Day . | |
| 415 | 12/1837 | Lindner . | |
| 1,304 | 8/1839 | Colt . | |
| 7,629 | 9/1850 | Colt . | |
| 14,905 | 5/1856 | Colt . | |
| 16,716 | 3/1857 | Colt . | |
| 20,144 | 5/1858 | Colt . | |
| 22,626 | 1/1859 | Colt . | |
| 34,126 | 1/1862 | Brady, Jr. et al. . | |
| 35,996 | 7/1862 | Doolittle . | |
| 514,490 | 2/1894 | McCullough . | |
| 515,064 | 2/1894 | Unge | 42/59 |
| 732,406 | 6/1903 | Goss . | |
| 1,342,359 | 6/1920 | Storle | 42/42 |
| 1,734,852 | 11/1929 | Frampton et al. . | |
| 2,560,292 | 7/1951 | Kauch | 42/59 |
| 3,030,723 | 4/1962 | Ivy | 42/65 |
| 3,045,556 | 7/1962 | Westmoreland | 42/65 |
| 4,694,602 | 9/1987 | Pust | 42/59 |

OTHER PUBLICATIONS

Unnumbered United States Patent to Samuel Colt, "Improvement in Fire–arms," dated Feb. 25, 1836.

*Primary Examiner*—Michael J. Carone
*Assistant Examiner*—Christopher K. Montgomery
*Attorney, Agent, or Firm*—Dunlap & Codding, P.C.

[57] ABSTRACT

A semiautomatic firearm having a rotating cylinder is provided. The cylinder has a plurality of chambers adapted to receive a cartridge and is rotatingly supported in a housing by a cylinder pin whereby each of the chambers of the cylinder is positionable in one of a loading position, a firing position, and an ejecting position. The cylinder pin is reciprocally movable between a retracted position wherein the cylinder pin is disengaged from a firing mechanism and an extended position wherein the cylinder pin engages the firing mechanism so as to cock the firing mechanism. The cylinder pin is movable from the retracted position to the extended position in response to gas pressure generated by the firing of a cartridge disposed in the chamber of the cylinder positioned in the firing position acting on the cylinder pin so as to move the cylinder pin from the retracted position to the extended position. The cylinder pin is urged from the extended position to the retracted position whereby a ratchet assembly causes the cylinder to rotate so as to move the chamber in the firing position to the ejecting position, the chamber in the ejecting position to the loading position, and the chamber in the loading position to the firing position. The fired case is expelled into a case receiving chamber in the stock upon the firing of the next round.

21 Claims, 4 Drawing Sheets

SEMIAUTOMATIC FIREARM WITH GAS OPERATED ROTATING CYLINDER

BACKGROUND OF THE INVENTION

1. Field of the Invention

The present invention relates generally to firearms, and more particularly, but not by way of limitation, to an improved firearm having a gas operated rotating cylinder for incrementally rotating a plurality of chambers of the cylinder between a loading position, a firing position, and an ejecting position.

2. Brief Description of Related Art

A firearm that is loaded manually for the first round and then upon pulling the trigger, the firearm fires, ejects the fired case, cocks the firing mechanism, and feeds a fresh round from the magazine is referred to as having a semiautomatic action. The trigger must be released between shots and be activated for each round fired until the magazine is empty.

Previous semiautomatic firearms have achieved varying degrees of success. However, semiautomatic firearms are generally costly to manufacture, as well as difficult to maintain, due to the relatively high number of parts used in the construction of such firearms. In addition, semiautomatic firearms pose safety and environmental concerns. That is, when semiautomatic firearms are fired, the fired case is ejected away from the firearm in such a fashion that injuries can be incurred due to the fired case being projected from the firearm and hitting a bystander. The ejected cases themselves pose a safety concern because when they are ejected onto the ground they can cause an individual to slip and fall if stepped on. The ejected cases are also an environmental concern in that empty cases littering the ground are unsightly and can be harmful to wildlife if swallowed.

To this end, a need has long existed for an improved semiautomatic firearm which is assembled from a minimal number of components and which provides a means for collecting ejected cases. It is to such an improved firearm that the present invention is directed.

BRIEF DESCRIPTION OF THE DRAWINGS

FIG. 6 is a cross sectional view taken at line 6—6 in FIG. 4 showing an ejecting tube aligned with a chamber of the cylinder in the ejecting position and an ejecting chamber in the buttstock.

DETAILED DESCRIPTION

Figure 1:
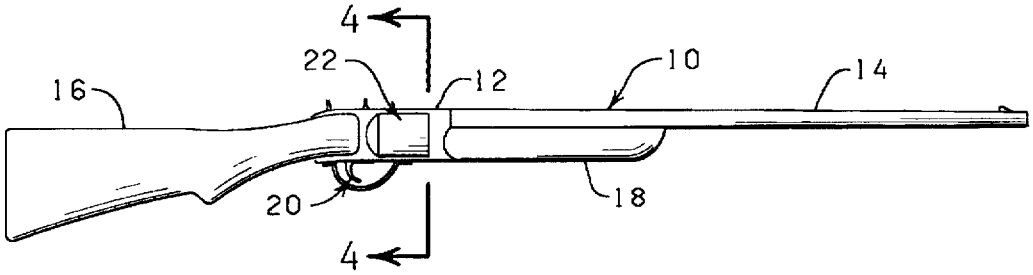
FIG. 1 is a side view of a firearm provided with a rotating cylinder mechanism and constructed in accordance with the present invention.
Figure 2:
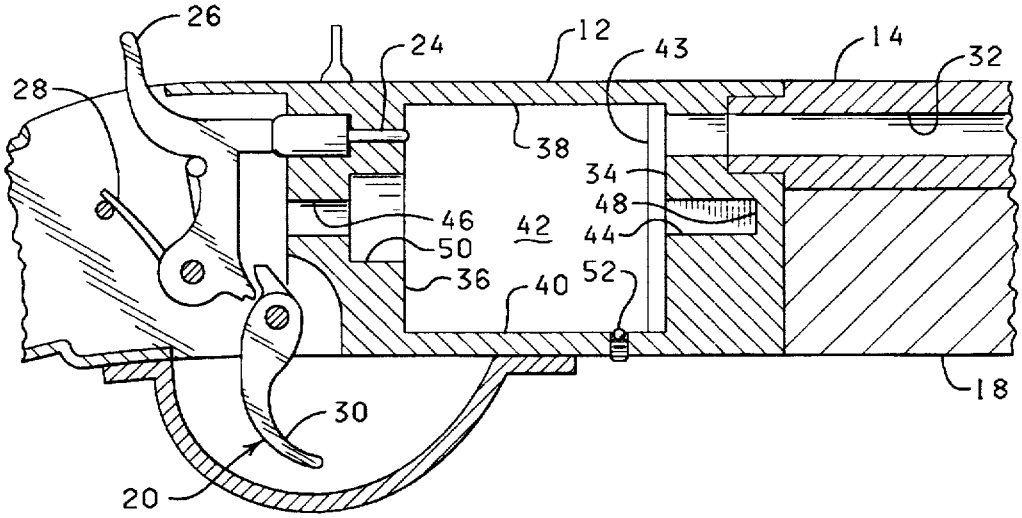
FIG. 2 is a partially cross sectional view of a portion of the firearm of the present invention shown with the rotating cylinder mechanism removed.

Referring now to the drawings, and more particularly to FIGS. 1 and 2, shown is a firearm 10 constructed in accordance with the present invention. More particularly, the firearm 10 shown in FIGS. 1 and 2 is a rifle having a housing 12, a barrel 14, a buttstock 16, a forestock 18, a firing mechanism 20, and a rotating cylinder mechanism 22. The firing mechanism 20 is of conventional construction and includes a firing pin 24, a hammer 26 pivotally connected to the housing 12 so as to be movable between a cocked position and an uncocked position, a spring 28, and a trigger 30 for retaining the hammer 26 in the cocked position in one mode and for selectively releasing the hammer 26 from the cocked position to permit the hammer 26 to move to the uncocked position to strike the firing pin 24. The barrel 14 is provided with a bore 32 which is in alignment with the firing pin 24. The barrel 14, the buttstock 16, the forestock 18, and the firing mechanism 20 are conventional components, as noted below, and the attachment of such components to the housing 12 is carried out in the customary manner. Thus, no further description of such components, except as otherwise described below, or the connection of such components to the housing 12 is believed necessary to enable one to understand the invention described herein.

For the purpose of this description, the present invention is described in the form of a rifle. However, it will be understood by those of ordinary skill in the art that the present invention is not limited to a rifle-type firearm, but is applicable to any device that fires a projectile or a mass of projectiles by means of a propellant charge and a triggering system, including rifles, shotguns, and pistols.

FIG. 2 is a partially cross sectional view of the housing 12 with the rotating cylinder mechanism removed for the sake of clarity. The housing 12 has an inner front surface 34, an inner rear surface 36, an inner upper surface 38, and an inner lower surface 40 cooperating to define a cylinder receiving space 42 which is in open communication with the bore 32 of the barrel 14. The inner front surface 34 is countersunk in the housing 12 so as to form an annular lip 43. The cylinder receiving space 42 is further in communication with a first cylinder pin receiving bore 44 formed in the inner front surface 34 of the housing 12 and a second cylinder pin receiving bore 46 formed in the inner rear surface 36 of the housing 12. The first cylinder pin receiving bore 44 is in alignment and open communication with the second cylinder pin receiving bore 46. The first cylinder pin receiving bore 44 is non-circularly shaped (shown herein as being square shaped) and is provided with a closed end 48 while the second cylinder pin receiving bore 46 extends through the housing 12 from the inner rear surface 36 substantially as shown in FIG. 2 so that the second cylinder pin receiving bore 46 is in alignment with a portion of the hammer 26. The second cylinder pin receiving bore 46 is provided with a counterbore 50.

The housing 12 supports a spring-loaded indexing detent 52 extending upward from the inner lower surface 40 of the housing 12 into the cylinder receiving space 42 thereof. The indexing detent 52 is adapted to cooperate with the cylinder mechanism 22 to properly position the cylinder mechanism 22 in a manner to be further described hereinbelow.

Referring now to FIGS. 3–7, the cylinder mechanism 22 includes a cylinder 54, a cylinder pin 56, and a ratchet mechanism 58. The cylinder 54 is adapted to be rotatingly disposed in the cylinder receiving space 42 of the housing 12. The cylinder 54 has a front end 60, a rear end 62, an outer peripheral surface 64, and three chambers 66 spaced radially about a central axis 68 of the cylinder 12, 120 degrees apart. Each of the chambers 66 is configured to receive and support a cartridge 70 (FIG. 5A), and each of the chambers 66 extends axially through the cylinder 54 from the rear end 62 to the front end 60.

To permit the cylinder 54 to be rotationally mounted in the housing 12, the cylinder 54 is provided with a cylinder pin receiving bore 72 extending through the cylinder 54 along the central axis 68 thereof. A piston receiving counterbore 74 is formed proximate the front end 60 of the cylinder 54. The cylinder 54 is also provided with three indexing recesses 76 formed in the outer peripheral surface 64 thereof. The indexing recesses 76 are positioned about the cylinder 54 and configured to receive the indexing detent 52 to properly position the cylinder 54 as will be described below.

The cylinder pin 56 is characterized as having a square shaped first end 78 and a second end 80. The cylinder pin 56 is provided with a helical portion, shown herein as helical grooves 82, extending from the second end 80 of the cylinder pin 56 a distance toward the first end 28 of the cylinder pin 56. It will be appreciated that the helical portion could also be formed of helical ridges or the like. The cylinder pin 56 is further provided with a piston 84 which is sized to be slidingly received in the piston receiving counterbore 74 of the cylinder 54.

As depicted in FIGS. 5A–5D, the cylinder pin 56 is sized to be slidingly disposed through the cylinder pin receiving bore 72 of the cylinder 54 with the first end 78 of the cylinder pin 56 slidingly and matingly disposed in the first cylinder pin receiving bore 44 of the housing 12 and the second end 80 of the cylinder pin 56 slidingly disposed in the second cylinder pin receiving bore 46 of the housing 12. The cylinder pin 56 is slidably disposed in the housing 12 and the cylinder 54 so that the cylinder pin 56 is movable between a retracted position (FIGS. 5A, 5B, and 5C) wherein the first end 78 of the cylinder pin 56 is engaged against the closed end 48 of the first cylinder pin receiving bore 44 of the housing 12 and the second end 80 of the cylinder pin 56 is disengaged from the hammer 26 and an extended position (FIG. 5B) wherein the second end 80 of the cylinder pin 56 engages the hammer 26 so as to move the hammer 26 from the uncocked position to the cocked position. A piston spring 86 is provided between the cylinder 54 and the piston 84 to bias the piston 84 and in turn the cylinder pin 56 in the retracted position. It will be appreciated that the mating relationship of the first end 78 of the cylinder pin 56 with the first cylinder pin receiving bore 44 of the housing 12 prevents rotation of the cylinder pin 56 relative to the housing 12.

The cylinder pin 56 further serves to rotatingly support the cylinder 54 in the cylinder receiving space 42 of the housing 12 so that each of the chambers 66 of the cylinder 54 is sequentially positionable in a loading position (illustrated by the chamber 66*a* in FIG. 7) wherein the chambers are aligned with a magazine 88, a firing position (illustrated by the chamber 66*b* in FIGS. 5A, 5B, and 5C) wherein the chambers 66 are aligned with the bore 32 of the barrel 14, and an ejecting position (illustrated by the chamber 66*c* in FIGS. 5A, 5B, 5C, and 6) wherein the chambers 66 are aligned with an ejecting tube 90.

As will be further described below, the cylinder mechanism 22 is actuated in response to gas pressure generated by the firing of a cartridge in the chamber positioned in the firing position. The generated gas, represented by the arrows 92 in FIG. 5B, exits the chamber in the firing position and a portion of such gas flows between the front end 60 of the cylinder 54 and the inner front surface 34 of the housing 12 and enters the piston receiving counterbore 74 of the cylinder 54 wherein such gas acts on the piston 84 to drive the piston 84 and thus the cylinder pin 56 from the retracted position to the extended position. The generated gas pressure is further utilized to expel a fired case from the chamber positioned in the ejecting position.

To focus the generated gas pressure on the piston, the cylinder 54 is sized so that the front end 60 of the cylinder 54 is spaced apart from the inner front surface 34 of the housing 12 a distance ranging from about 0.0005 inches to about 0.007 inches to provide a gas flow passageway 93 through which each of the chambers 66*a*, 66*b*, and 66*c* of the cylinder 54 is in fluid communication with one another and with the piston receiving counterbore 74 of the cylinder 54. The annular lip 43 of the housing 12 which extends over a portion of the outer peripheral surface 64 of the cylinder 54 proximate the front end 60 thereof also serves to capture and focus the generated gas pressure.

The ratchet mechanism 58 serves to rotate the cylinder 54 in response to movement of the cylinder pin 56 from the extended position to the retracted position whereby the chamber in the firing position is rotated to the ejecting position, the chamber in the ejecting position is rotated to the loading position, and the chamber in the loading position is rotated to the firing position. The ratchet mechanism 58 includes a ratchet element 94 (FIG. 3A) formed in the rear end 62 of the cylinder 54, a drive wheel 96, and a ratchet spring 98.

Figure 3:
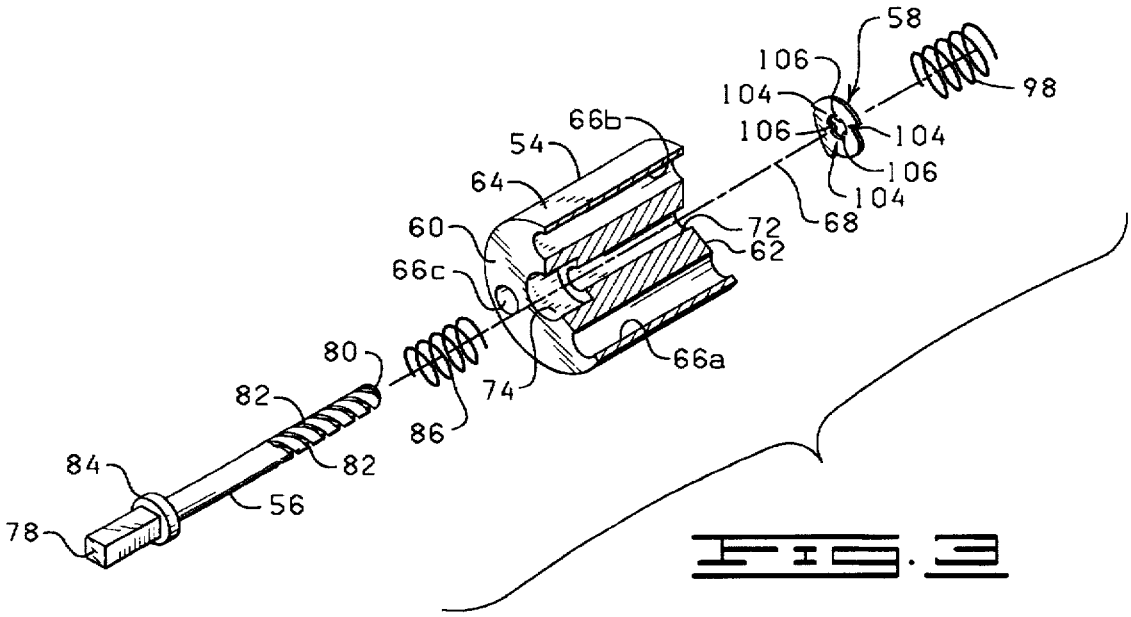
FIG. 3 is a partially sectional, exploded view of the rotating cylinder mechanism.
Figure 3A:
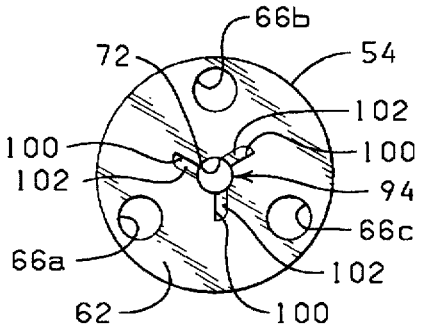
FIG. 3A is a rear end view of the cylinder in FIG. 3.
Figure 4:
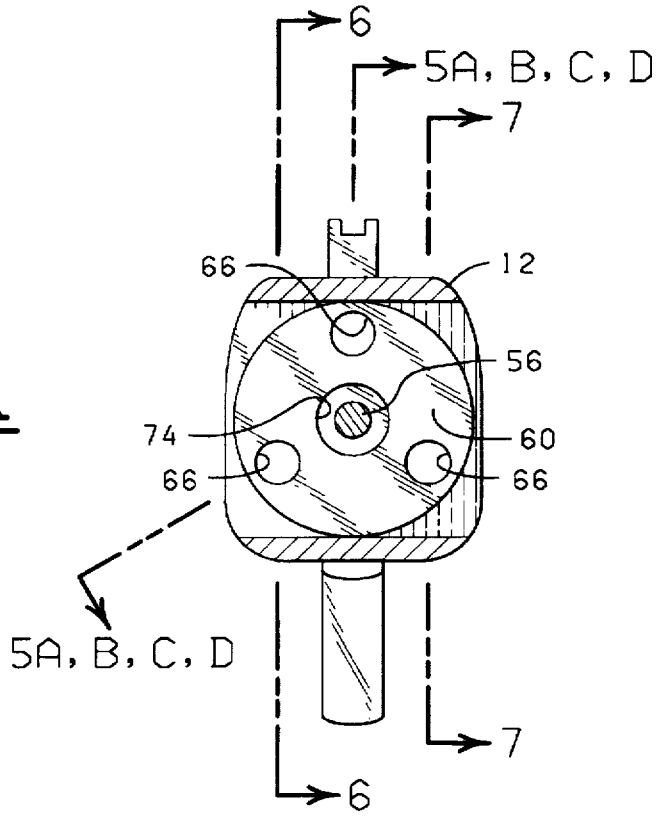
FIG. 4 is a cross section taken at line 4—4 in FIG. 1.

As best shown in FIG. 3A, the ratchet element 94 is integrally formed in the rear end 62 of the cylinder 54. However, it will be appreciated by those skilled in the art that the ratchet element 94 can also be formed as a separate component which is fixed to the cylinder 54 in a conventional manner. The ratchet element 94 includes a plurality of radially extending engagement surfaces 100 and a plurality of corresponding inclined surfaces 102.

The drive wheel 96 has a plurality of pawl members 104 extending therefrom which are adapted to drivingly engage the engagement surfaces 100 of the ratchet element 94 when the drive wheel 96 is rotated in one direction and to slidably engage the inclined surfaces 102 of the ratchet element 94 when the drive wheel 96 is rotated in the opposite direction. To effect rotation of the drive wheel 96, the drive wheel 96 is provided with a plurality of inwardly radially extending protrusions 106 which are configured to slidingly mate with the helical grooves 82 of the cylinder pin 56.

As depicted in FIGS. 5A–5D, the drive wheel 96 is slidingly and matingly disposed in the helical grooves 82 of the cylinder pin 56 whereby the drive wheel 96 is caused to rotate in a first or counterclockwise direction when the cylinder pin 56 moves from the retracted position to the extended position and to rotate in a second or clockwise direction when the cylinder pin 56 moves from the extended position to the retracted position. The pawl elements 104 of the drive wheel 96 are configured to drivingly engage the engagement surfaces 100 of the ratchet element 94 so as to rotate the cylinder 54 when the drive wheel 96 is rotated in the second direction, and each pawl element 104 is configured to disengage the engagement surfaces 100 of the ratchet element 94 when the drive wheel 96 is rotated in the first direction. It will be appreciated that the helical grooves 82 of the cylinder pin 56 are oriented so as to cause the drive wheel to rotate through an angle of 120 degrees in a counterclockwise direction as the cylinder pin 56 moves from the retracted position to the extended position and to cause the cylinder 54 to rotate 120 degrees in a clockwise direction as the cylinder pin 56 moves from the extended position to the retracted position thereby indexing the pawl elements 104 of the drive wheel 96 with the engagement surfaces 100 of the ratchet element 94.

The ratchet spring 98 is housed in the counterbore 50 of the housing 12 such that the ratchet spring 98 is positioned between the housing 12 and the drive wheel 96 to resiliently urge the drive wheel 96 against the ratchet element 94.

FIG. 6 is a cross sectional view of the housing 12 and the buttstock 16 taken through a line extending through the chamber of the cylinder positioned in the ejecting position (illustrated in FIG. 6 by the chamber 66*c*). As illustrated, the buttstock 16 has a case receiving chamber 108 in open communication with the chamber of the cylinder 54 positioned in the ejecting position for receiving the empty case of a fired cartridge expelled from the chamber in the ejecting position. An ejecting tube 90 is disposed through the housing 12 to provide a passageway between the chamber in the ejecting position and the case receiving chamber 108. The case receiving chamber 108 is accessed via a removable panel 112 of the buttstock 16 for selectively removing the cases collected in the buttstock 16.

Figure 7:
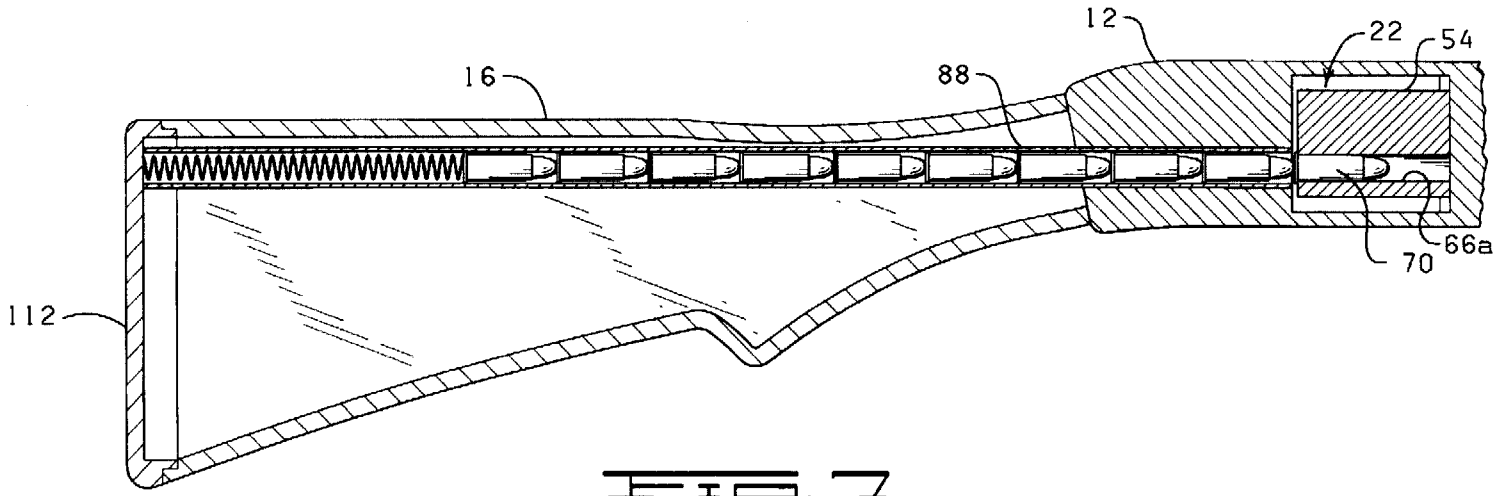
FIG. 7 is a cross sectional view taken at line 7—7 in FIG. 4 showing a magazine in the buttstock aligned with a chamber of the cylinder in the loading position.

FIG. 7 is a cross sectional view of the housing 12 and the buttstock 16 taken through a line extending through the chamber 66 of the cylinder 54 positioned in the loading position (illustrated in FIG. 7 by the chamber 66*a*). As shown, the buttstock 16 and the housing 12 are adapted to house the magazine 88, shown herein as a tubular magazine, for storing a plurality of cartridges and for feeding the cartridges 70 one by one into the chambers 66 as the chambers 66 are rotated into the loading position.

Operation

Figure 5A:
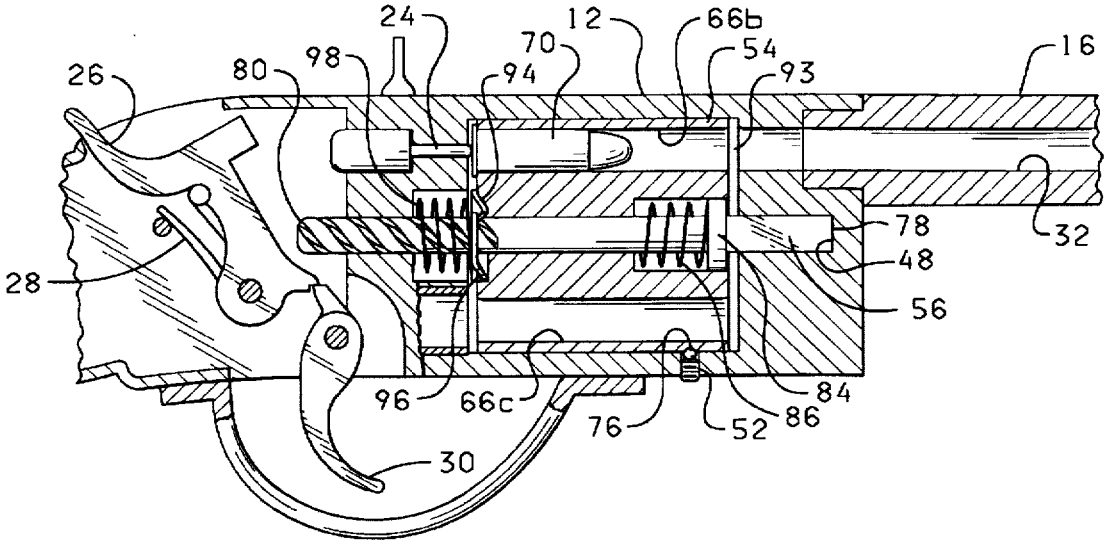
FIG. 5A is a cross section taken at line 5A,B,C,D of FIG. 4 showing a cylinder pin in a retracted position and a hammer in a cocked position.
Figure 5B:
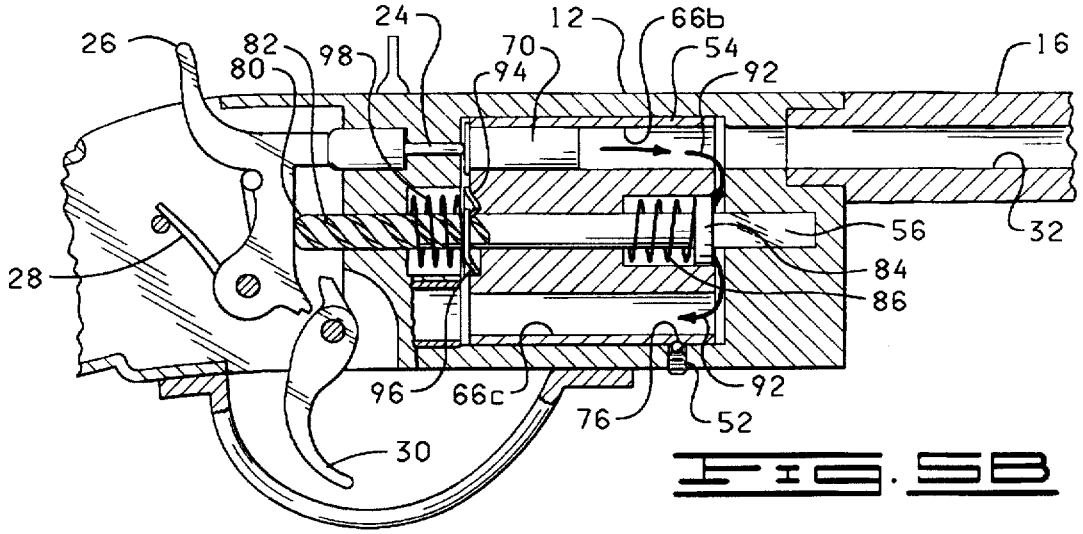
FIG. 5B is a partially cross sectional view of a portion of the firearm of the present invention showing the cylinder pin in a retracted position and the hammer in an uncocked or firing position.
Figure 5C:
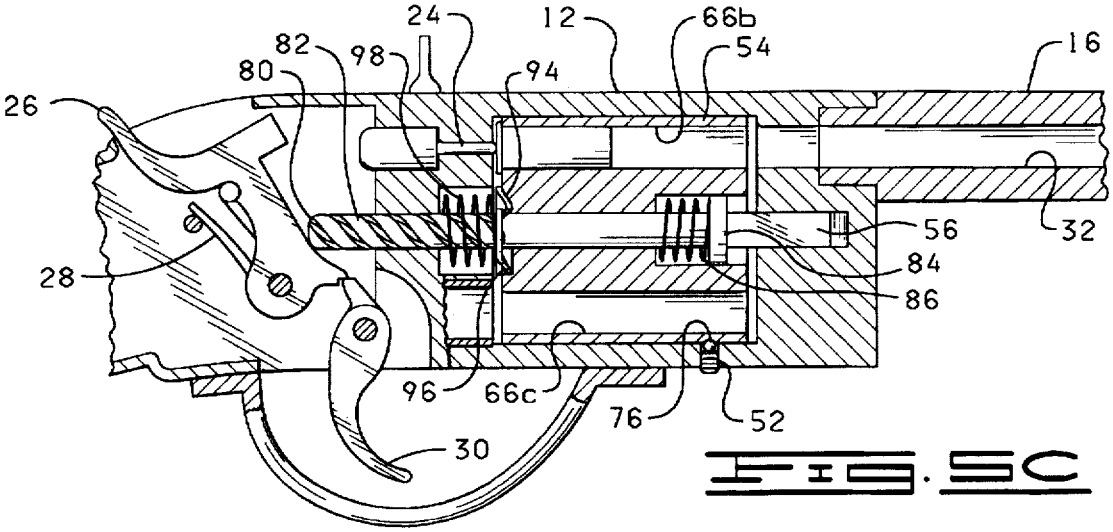
FIG. 5C is a partially cross sectional view of a portion of the firearm of the present invention showing the cylinder pin in an extended position and the hammer in the cocked position.

In operation, one of the cartridges 70 is initially loaded into the chamber 66*a* positioned in the loading position (FIG. 7) and the chamber 66*b* positioned in the firing position (FIG. 5A) and the firing mechanism 20 is manually cocked (FIG. 5A). Upon pulling the trigger 30, the hammer 26 strikes the firing pin 24 which in turn causes the cartridge 70 in the chamber 66*b* in the loading position to fire (FIG. 5B). Gas pressure 92 generated by the firing of the cartridge 70 disposed in the chamber 66*b* of the cylinder 54 positioned in the firing position acts on the piston 84 so as to move the cylinder pin 56 from the retracted position to the extended position (FIG. 5C). As the cylinder pin 56 moves from the retracted position to the extended position, the drive wheel 96 is caused to rotate in the first or counterclockwise position whereby the drive wheel 96 slidingly rotates over the inclined surfaces 102 of the ratchet element 94, and the second end 80 of the cylinder pin 56 engages the hammer 26 so as to move the hammer 26 from the uncocked position to the cocked position (FIG. 5C).

Figure 5D:
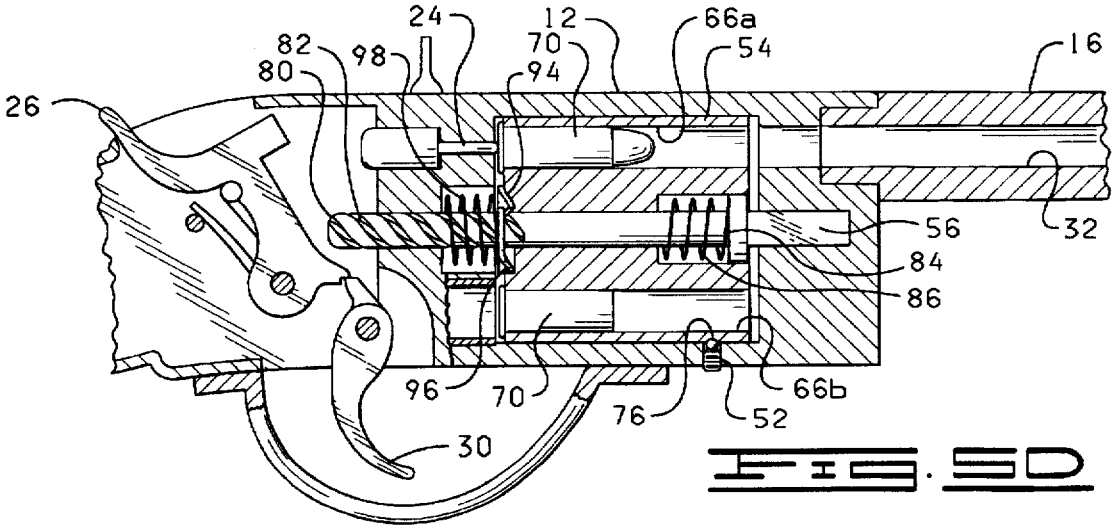
FIG. 5D is a partially cross sectional view of a portion of the firearm of the present invention showing the cylinder pin in the retracted position with the cylinder rotated 120 degrees.
Figure 5:
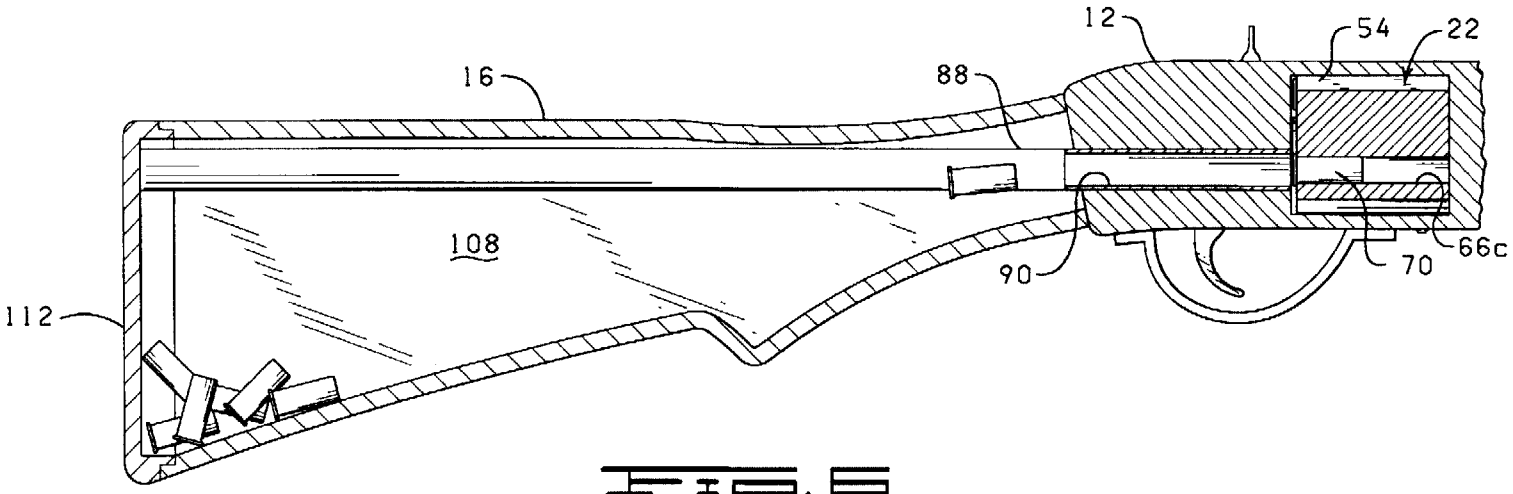

Upon the gas pressure 92 dissipating, the piston spring 86 causes the cylinder pin 56 to return to the retracted position (FIG. 5D). As the cylinder pin 56 moves from the extended position to the retracted position, the drive wheel 96 is caused to drivingly engage the ratchet element 94 and the helical grooves 82 of the cylinder pin 56 cooperate with the protrusions 106 of the drive wheel 56 to cause the drive wheel 56 to rotate thereby causing the cylinder 54 to rotate. The cylinder 54 is rotated by the drive wheel 96 through an angle of 120 degrees whereby the chamber 66*b* in the firing position is rotated to the ejecting position, the chamber 66*c* in the ejecting position is rotated to the loading position, and the chamber 66*a* in the loading position is rotated to the firing position. As mentioned above, the cylinder 54 is maintained in the proper position by the indexing detent 52 registering with the indexing recesses 76 of the cylinder 54 upon the cylinder 54 rotating 120 degrees. With the cylinder 54 having rotated, the chamber 66*b* in the ejecting position contains the fired case of the cartridge 70, the chamber 66*a* in the firing position contains a cartridge 70 and the chamber 66*c* in the loading position contains a cartridge 70 received from the magazine 88 upon the chamber 66*c* aligning with the magazine 88.

Upon pulling the trigger 30 again, the hammer 26 strikes the firing pin 24 which in turn causes the cartridge 70 in the chamber 66*a* in the firing position to fire thereby generating gas pressure which expels the propellant of the cartridge 70 through the chamber 66*a* and the bore 32 of the barrel 14. In addition to actuating the piston 84, the gas pressure 92 generated by the fired cartridge also forces the empty case of the fired cartridge 70 from the chamber 66*b* in the ejecting position. The gas pressure 92 enters the chamber 66*b* in the ejecting position and forces the case out of the chamber 66*b*, through the ejecting tube 110, and into the case receiving chamber 108 of the buttstock 16.

The construction of the previously described invention provides many advantages, including the cost effectiveness of manufacturing and ease of maintenance due to the minimal number of parts required in the assembly of the firearm. The minimal number of components further results in a firearm that is lighter in weight and thus easier to handle. Also, by having a case receiving chamber for collecting the fired cases, safety is greatly increased in that the empty cases will not be projected from the firearm so as to pose a problem for bystanders or the shooter, and environmental concerns associated with empty cases being ejected onto the ground are alleviated.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed:

1. A firearm, comprising:

a housing having a front surface, a rear surface, an upper surface, and a lower surface cooperating to define a cylinder receiving space, the housing having a first cylinder pin receiving bore formed through the front surface of the housing and a second cylinder pin receiving bore formed through the rear surface of the housing in alignment and open communication with the first cylinder pin receiving bore;

a barrel extending from the housing and having a bore in communication with the cylinder receiving space;

a cylinder adapted to be rotatingly disposed in the cylinder receiving space of the housing, the cylinder having a front end, a rear end, an outer peripheral surface, and a plurality of chambers, each of the chambers adapted to receive a cartridge, spaced radially about a central axis of the cylinder, and extended axially through the cylinder from the rear end to the front end, the cylinder having a cylinder pin receiving bore extending through the cylinder along the central axis thereof and a piston receiving counterbore formed proximate the front end of the cylinder;

a cylinder pin having a first end and a second end, the cylinder pin slidingly disposed through the cylinder pin bore of the cylinder with the first end of the cylinder pin slidingly disposed in the first cylinder pin receiving bore of the housing and the second end of the cylinder pin slidingly disposed in the second cylinder pin receiving bore of the housing so that the cylinder is rotatingly supported in the cylinder receiving space of the housing whereby each of the chambers of the cylinder is positionable in one of a loading position, a firing position, and an ejecting position, each of the chambers being in fluid communication with the piston receiving counterbore of the cylinder and aligned with the bore of the barrel when the chambers are in the firing position;

a hammer movable between a cocked position and an uncocked position;

trigger means for retaining the hammer in the cocked position in one mode and for selectively releasing the hammer from the cocked position to permit the hammer to move to the uncocked position so as to cause the cartridge in the firing position to fire in another mode;

a piston connected to the cylinder pin and slidingly disposed in the piston receiving counterbore of the cylinder such that the cylinder pin is reciprocally movable between a retracted position wherein the second end of the cylinder pin is disengaged from the hammer and an extended position wherein the second end of the cylinder pin engages the hammer so as to move the hammer from the uncocked position to the cocked position, the cylinder pin movable from the retracted position to the extended position in response to gas pressure generated by the firing of the cartridge disposed in the chamber of the cylinder positioned in the firing position acting on the piston so as to move the cylinder pin from the retracted position to the extended position;

means for moving the cylinder pin from the extended position to the retracted position; and ratchet means for rotating the cylinder in response to movement of the cylinder pin from the extended position to the retracted position whereby the chamber in the firing position is rotated to the ejecting position, the chamber in the ejecting position is rotated to the loading position, and the chamber in the loading position is rotated to the firing position.

2. The firearm of claim 1 wherein the chamber in the ejecting position is in fluid communication with the chamber in the firing position, and wherein a case of the cartridge is ejected from the chamber of the cylinder in the ejecting position by gas pressure generated by the firing of the cartridge disposed in the chamber of the cylinder positioned in the firing position acting on the case so as to expel the case disposed in the chamber in the ejecting position from such chamber.

3. The firearm of claim 2 further comprising:

a stock connected to the housing, the stock having a case receiving chamber in open communication with the chamber of the cylinder positioned in the ejecting position for receiving the case expelled from the chamber in the ejecting position.

4. The firearm of claim 3 wherein the stock is provided with an access opening for selectively removing the cases expelled into the stock.

5. The firearm of claim 1 wherein the means for moving the cylinder pin from the extended position to the retracted position comprises:

biasing means connected between the piston and the cylinder for biasing the cylinder pin in the retracted position.

6. The firearm of claim 1 wherein at least a portion of the cylinder pin is provided with a helical portion, and wherein the ratchet means comprises:

a ratchet element on the rear end of the cylinder, the ratchet element having a plurality of engagement surfaces circumferentially spaced from the central axis of the cylinder; and a drive wheel slidingly and matingly disposed on the helical portion of the cylinder pin whereby the drive wheel is caused to rotate in a first direction when the cylinder pin moves from the retracted position to the extended position and to rotate in a second direction when the cylinder pin moves from the extended position to the retracted position, the drive wheel having a plurality of pawl elements corresponding to the engagement surfaces of the ratchet element, each of the pawl elements configured to drivingly engage the engagement surfaces of the ratchet element so as to rotate the cylinder whereby the chamber in the firing position is rotated to the ejecting position, the chamber in the ejecting position is rotated to the loading position, and the chamber in the loading position is rotated to the firing position when the drive wheel is rotated in the second direction and each pawl element configured to disengage the engagement surfaces of the ratchet element when the drive wheel is rotated in the first direction.

7. The firearm of claim 1 wherein the front end of the cylinder is spaced apart from the front surface of the housing a distance ranging from about 0.0005 inches to about 0.007 inches.

8. The firearm of claim 1 further comprising:

indexing means for indexing one of the chambers of the cylinder with the bore of the barrel.

9. The firearm of claim 1 further comprising:

magazine means in open communication with the chamber in the loading position for storing a plurality of cartridges and for feeding one of the cartridges into the chamber in the loading position.

10. A firearm, comprising:

a housing having a front surface, a rear surface, an upper surface, and a lower surface cooperating to define a cylinder receiving space, the housing having a first cylinder pin receiving bore formed through the front surface of the housing and a second cylinder pin receiving bore formed through the rear surface of the housing in alignment and open communication with the first cylinder pin receiving bore;

a barrel extending from the housing and having a bore in communication with the cylinder receiving space;

a cylinder rotatingly disposed in the cylinder receiving space of the housing, the cylinder having a front end, a rear end, an outer peripheral surface, and a plurality of chambers, each of the chambers adapted to receive a cartridge, spaced radially about a central axis of the cylinder, extended axially through the cylinder from the rear end to the front end, and positionable in one of a loading position, a firing position, and an ejecting position, the chamber in the firing position being aligned with the bore of the barrel and the chamber in the ejecting position being in fluid communication with the chamber in the firing position whereby a case of the cartridge is ejected from the chamber of the cylinder in the ejecting position by gas pressure generated by the firing of the cartridge disposed in the chamber of the cylinder positioned in the firing position acting on the case so as to expel the case disposed in the chamber in the ejecting position from such chamber; and means for firing the cartridge disposed in the chamber in the firing position whereby the case of the cartridge disposed in the ejecting position is ejected from the chamber of the cylinder in the ejecting position by gas pressure generated by the firing of the cartridge disposed in the chamber of the cylinder positioned in the firing position acting on the case so as to expel the case disposed in the chamber in the ejecting position from such chamber.

11. The firearm of claim 10 further comprising:

a stock connected to the housing, the stock having a case receiving chamber in open communication with the chamber of the cylinder positioned in the ejecting position for receiving the case expelled from the chamber in the ejecting position.

12. The firearm of claim 11 wherein the stock is provided with an access opening for selectively removing the case expelled into the stock.

13. A firearm, comprising:

a housing having a front surface, a rear surface, an upper surface, and a lower surface cooperating to define a cylinder receiving space, the housing having a first cylinder pin receiving bore formed through the front surface of the housing and a second cylinder pin receiving bore formed through the rear surface of the housing in alignment and open communication with the first cylinder pin receiving bore;

a barrel extending from the housing and having a bore in communication with the cylinder receiving space;

a cylinder adapted to be rotatingly disposed in the cylinder receiving space of the housing, the cylinder having a front end, a rear end, an outer peripheral surface, and a plurality of chambers, each of the chambers adapted to receive a cartridge, spaced radially about a central axis of the cylinder, and extended axially through the cylinder from the rear end to the front end, the cylinder having a cylinder pin receiving bore extending through the cylinder along the central axis thereof and a piston receiving counterbore formed proximate the front end of the cylinder;

a cylinder pin having a first end and a second end, the cylinder pin slidingly disposed through the cylinder pin bore of the cylinder with the first end of the cylinder pin slidingly disposed in the first cylinder pin receiving bore of the housing and the second end of the cylinder pin slidingly disposed in the second cylinder pin receiving bore of the housing so that the cylinder is rotatingly supported in the cylinder receiving space of the housing whereby each of the chambers of the cylinder is positionable in one of a loading position, a firing position, and an ejecting position, each of the chambers being in fluid communication with the piston receiving counterbore of the cylinder and aligned with the bore of the barrel when the chambers are in the firing position;

means for firing the cartridge disposed in the chamber in the firing position;

a piston connected to the cylinder pin and slidingly disposed in the piston receiving counterbore of the cylinder such that the cylinder pin is reciprocally movable between a retracted position and an extended position, the cylinder pin movable from the retracted position to the extended position in response to gas pressure generated by the firing of the cartridge disposed in the chamber of the cylinder positioned in the firing position acting on the piston so as to move the cylinder pin from the retracted position to the extended position;

means for moving the cylinder pin from the extended position to the retracted position; and ratchet means for rotating the cylinder in response to movement of the cylinder pin from the extended position to the retracted position whereby the chamber in the firing position is rotated to the ejecting position, the chamber in the ejecting position is rotated to the loading position, and the chamber in the loading position is rotated to the firing position.

14. The firearm of claim 13 wherein the chamber in the ejecting position is in fluid communication with the chamber in the firing position, and wherein a case of the cartridge is ejected from the chamber of the cylinder in the ejecting position by gas pressure generated by the firing of the cartridge disposed in the chamber of the cylinder positioned in the firing position acting on the case so as to expel the case disposed in the chamber in the ejecting position from such chamber.

15. The firearm of claim 14 further comprising:

a stock connected to the housing, the stock having a case receiving chamber in open communication with the chamber of the cylinder positioned in the ejecting position for receiving the case expelled from the chamber in the ejecting position.

16. The firearm of claim 15 wherein the stock is provided with an access opening for selectively removing the cases expelled into the stock.

17. The firearm of claim 13 wherein the means for moving the cylinder pin from the extended position to the retracted position comprises:

biasing means connected between the piston and the cylinder for biasing the cylinder pin in the retracted position.

18. The firearm of claim 13 wherein at least a portion of the cylinder pin is provided with a helical portion, and wherein the ratchet means comprises:

a ratchet element on the rear end of the cylinder, the ratchet element having a plurality of engagement surfaces circumferentially spaced from the central axis of the cylinder; and a drive wheel slidingly and matingly disposed on the helical portion of the cylinder pin whereby the drive wheel is caused to rotate in a first direction when the cylinder pin moves from the retracted position to the extended position and to rotate in a second direction when the cylinder pin moves from the extended position to the retracted position, the drive wheel having a plurality of pawl elements corresponding to the engagement surfaces of the ratchet element, each of the pawl elements configured to drivingly engage the engagement surfaces of the ratchet element so as to rotate the cylinder whereby the chamber in the firing position is rotated to the ejecting position, the chamber in the ejecting position is rotated to the loading position, and the chamber in the loading position is rotated to the firing position when the drive wheel is rotated in the second direction and each pawl element configured to disengage the engagement surfaces of the ratchet element when the drive wheel is rotated in the first direction.

19. The firearm of claim 13 wherein the front end of the cylinder is spaced apart from the front surface of the housing a distance ranging from about 0.0005 inches to about 0.007 inches.

20. The firearm of claim 13 further comprising:

indexing means for indexing one of the chambers of the cylinder with the bore of the barrel.

21. The firearm of claim 13 further comprising:

magazine means in open communication with the chamber in the loading position for storing a plurality of cartridges and for feeding one of the cartridges into the chamber in the loading position.

* * * * *